United States Patent [19]

Dubrovsky et al.

[11] 4,428,419

[45] Jan. 31, 1984

[54] TUBE-AND-FIN HEAT EXCHANGER

[76] Inventors: Evgeny V. Dubrovsky, ultisa Chaikovskogo, 18, kv. 203, Moscow; Leonid A. Averkiev, ulitsa Gagarina, 40a, kv. 137, Orenburg; Viktor P. Dunaev, ulitsa I Vladimirskaya, 26, korpus 2, kv. 31, Moscow; Anatoly I. Kuzin, ulitsa Flotskaya, 17, korpus 1, kv. 106, Moscow; Natalya I. Martynova, ulitsa Komsomolskaya, 15, kv. 38, Ljubertsy Moskovskoi oblasti; Lev A. Folts, ulitsa Timiryazeva, 14, kv. 1; Arthur P. Shmelev, ulitsa Sukhareva, 36, kv. 61, both of Orenburg; Sergei S. Vronsky, ulitsa Chicherina, 26, kv. 27; Evgeny V. Vasiliev, ulitsa 60 let Oktyabrya, 20, kv. 28, both of Orenburg, all of U.S.S.R.

[21] Appl. No.: 305,631

[22] PCT Filed: Jan. 15, 1981

[86] PCT No.: PCT/SU81/00001

§ 371 Date: Sep. 21, 1981

§ 102(e) Date: Sep. 21, 1981

[87] PCT Pub. No.: WO81/02197

PCT Pub. Date: Aug. 6, 1981

[30] Foreign Application Priority Data

Jan. 28, 1980 [SU] U.S.S.R. ..... 2876816

[51] Int. Cl.[3] ..... F28D 1/00

[52] U.S. Cl. ..... 165/151; 165/109 R

[58] Field of Search ..... 165/151, 148, 149, 152, 165/153; 29/157.3 A, 157.3 C; 165/182, 185, 170, 166, 167

[56] References Cited

FOREIGN PATENT DOCUMENTS

| | | | |
|---|---|---|---|
| 360280 | 11/1931 | United Kingdom | 165/151 |
| 389277 | 10/1973 | U.S.S.R. | 165/151 |
| 591684 | 2/1978 | U.S.S.R. | 165/185 |
| 658360 | 4/1979 | U.S.S.R. | 165/151 |

*Primary Examiner*—William R. Cline
*Assistant Examiner*—John F. McNally
*Attorney, Agent, or Firm*—Fleit, Jacobson, Cohn & Price

[57] ABSTRACT

A tube-and-fin heat exchanger comprising tubes (1) for the flow of a heat carrier at some temperature, said tubes being installed in broached holes (9) provided in a stack of fins (2,3). The tubes (1) are installed so that adjacent fins (2,3) form a multiplicity of ducts for the flow of another heat carrier at a different temperature. Each fins (2,3) is provided with projections (4) and depressions (5) which form in the ducts symmetrical divergent-convergent portions for setting up turbulence in the heat carrier flow layer at the wall. The fins (2 and 3) have rectilinear portions (8) located between the divergent-convergent portions and situated opposite each other on adjacent fins (2 and 3).

6 Claims, 5 Drawing Figures

TUBE-AND-FIN HEAT EXCHANGER

TECHNICAL FIELD

This invention relates to the art of heat engineering and has particular reference to tube-and-fin heat exchangers.

The proposed apparatus may be used in a wide variety of applications as liquid-to-air or air-to-air heat exchangers and may also be employed in air-cooled condensers and evaporators intended for handling various liquids. Said apparatus can operate on dust-free air as well as on dusty air.

The apparatus of the invention may be used with particular advantage as water-to-air radiators and air-cooled oil coolers in the cooling system of transport and stationary power installations.

BACKGROUND ART

Known in the art is a tube-and-fin heat exchanger employed as a water-to-air radiator on motor vehicles, tractors and diesel locomotives. This apparatus comprises flat or round tubes intended for the passage of the coolant flow and installed in appropriate broached holes provided in flat plates serving as cooling fins. The coolant tubes may be disposed in parallel or staggered rows. With this construction, plain rectangular ducts are formed between the tubes, said ducts having no turbulence producing means required for intensifying the heat exchange process in the intertubular space.

Said means for intensifying the heat exchange process have to be provided because the water-to-air radiators of various power installations operate under conditions where the radiator heat transfer coefficient K is approximately equal to the air heat transfer coefficient $\alpha_1$, i.e., $K \approx \alpha_1$. Therefore, decreasing the volume and mass of a water-to-air radiator necessitates increasing K which is uniquely determined by the value of $\alpha_1$. As is known, plain ducts give the least values of $\alpha_1$. Therefore, the known tube-and-fin heat exchanger has a substantial size and mass.

To decrease the size and mass of the water radiators of the known type, the air heat transfer coefficient $\alpha_1$ has to be increased, which can be accomplished only by setting up turbulence in the air flow through the radiator passages by the agency of various turbulence producing means.

Also known in the art is a tube-and-fin heat exchanger comprising flat tubes intended for the passage of the water being cooled and installed in parallel or staggered rows in a stack of fins. In order to intensify the process of convective heat transfer in the intertubular space, the fins are profiled in the direction of the cooling air flow as a continuous symmetrical wavy line, whilst adjacent fins are installed in the tube bank so that the projections and depressions of said fins are disposed equidistantly with respect to each other. Consequently, between adjacent fins cooling air ducts are formed which have a wavy profile in the direction of the air flow.

The analysis of the results of tests of the water-to-air radiators of the type under consideration shows that such radiators give little thermohydraulic effectiveness inasmuch as the increase of the air heat transfer coefficient $\alpha_1$ in the aforementioned ducts substantially lags behind the increase in the energy expended in intensifying heat transfer therein, as compared with similar plain ducts. This is attributed to the fact that when air flows in such ducts a vortex system is set up after each turn and therebefore, said system being equal in scale to or commensurable with the height of the projection in the wavy duct, whereas the height of the projection in such ducts is equal to or commensurable with the duct hydraulic diameter. As a result, up to 70–80 percent of the supplementary energy supplied to the cooling air in said wavy ducts is expended in setting up turbulence in the flow core where the gradients of the temperature field and the density of the thermal flow are small, which entails little increase in the density of the thermal flow. Since these large-scale vortex systems possess substantial kinetic energy, they, overcoming viscosity and friction forces, gradually become dissipated and enter the air layer at the walls. As a result, turbulence is set up in said air layer with consequent increase of turbulent conduction and density of the heat flow. Therefore, intensification of heat transfer in the wavy duct is effected mainly by setting up turbulence in the flow layer at the wall, not in the flow core, although the greater part of the supplementary energy supplied to the air flow in the wavy duct is expended in setting up turbulence in the flow cre, not in the layer at the wall. This is the reason for low thermohydraulic effectiveness of the heat transfer surface of said tube-and-fin heat exchanger known in the prior art.

Also known in the prior art is a tube-and-fin heat exchanger comprising a stack of fins spaced apart. The tubes are installed in broached holes provided in the fins. One heat-transfer medium flows through the tubes. Adjacent fins and the walls of adjacent tubes form ducts for the flow of the other heat-transfer medium whose temperature differs from that of the first-mentioned heat-transfer medium. Heat transfer is effected between said media. Each of the fins is made in the form of a continuous symmetrical wavy line. In order to intensify the process of convective heat transfer, the projections and depressions on each fin are located respectively opposite the projections and depressions on the adjacent fins. With this construction, continuous divergent-convergent duct portions are formed in the direction of heat carrier flow, the divergence angle being substantially greater than the critical angle for the initial upsetting of hydrodynamic stability of the laminary structure of the heat carrier flow. This results in setting up three-dimensional twisted vortices in the boundary layer. Eddy viscosity and conduction sharply increase in this layer. The temperature gradient and the density of the thermal flow increase, entailing increase in the coefficient $\alpha_1$ of heat transfer between the heat carrier and the walls of the divergent-convergent ducts. Energy-consuming vortices are generated in the divergent portions of the ducts under certain conditions of throttling and heat carrier flow. The interaction of the vortices therebetween and with the main flow of the heat carrier causes diffusion of said vortices into the flow core. The total energy of generation and propagation of the vortices exceeds the energy of their dissipation. Therefore, the expenditure of energy on forcing the heat carrier flow increases materially with insignificant increase in the intensification of the heat transfer. This physical characteristic of the heat transfer intensification process inherent in the apparatus under consideration entails substantial decrease in the thermodynamic effectiveness thereof.

DISCLOSURE OF THE INVENTION

The invention is essentially aimed at providing a tube-and-fin heat exchanger in which ducts with turbulence producing means for passing one of heat carriers are designed so that turbulence would be set up only in a wall-neighbouring layer of the heat carrier flow without interaction of vortices therebetween and the flow core, thereby intensifying the process of heat transfer.

This is accomplished by that a tube-and-fin heat exchanger comprising tubes for the flow of a heat carrier at some temperature, which tubes are installed in broached holes provided in fins spaced apart and positioned so that adjacent fins and walls of adjacent tubes form a multiplicity of ducts for the flow of a heat carrier at a different temperature, each of the fins having projections and depressions located respectively opposite projections and depressions on the adjacent fins so as to form in said ducts symmetrical divergent-convergent portions for setting up turbulence in the wall-neighbouring layer of the heat carrier flowing therethrough, according to the invention said fins also have rectilinear portions provided between the divergent-convergent portions and positioned opposite each other on the adjacent fins.

This construction makes it possible to obviate interaction of the wall-neighbouring vortices therebetween and with the flow core, whereby energy expended in intensifying the process of heat transfer is reduced.

It is desirable that the length of the rectilinear portions of the fins should not exceed the dimension appropriate for the laminar structure of the wall-neighbouring layer of the heat carrier flow rendered turbulent in the divergent-convergent portion of the duct to be restored in the rectilinear portion.

This expedient makes it possible to fully utilize the energy of the vortices generated in the wall-neighbouring layer.

It is further desirable that the length of the rectilinear portions of the fins should not exceed five equivalent hydraulic diameters of the rectilinear portions of the ducts.

This expedient gives the highest thermohydraulic effectiveness and provides for decreasing the size and mass of the apparatus.

In order to ensure uniform distribution of the heat carrier in said ducts, the rectilinear portions of the fins should be located in the plane of symmetry of the respective fin.

It is still further desirable that, for the purpose of manufacturability of the apparatus, each divergent-convergent portion should be formed by at least one projection mating with at least one depression.

BRIEF DESCRIPTION OF THE DRAWINGS

The invention will now be more particularly described by way of example with reference to the accompanying drawings, wherein.

BEST MODE OF CARRYING OUT THE INVENTION

Figure 1:
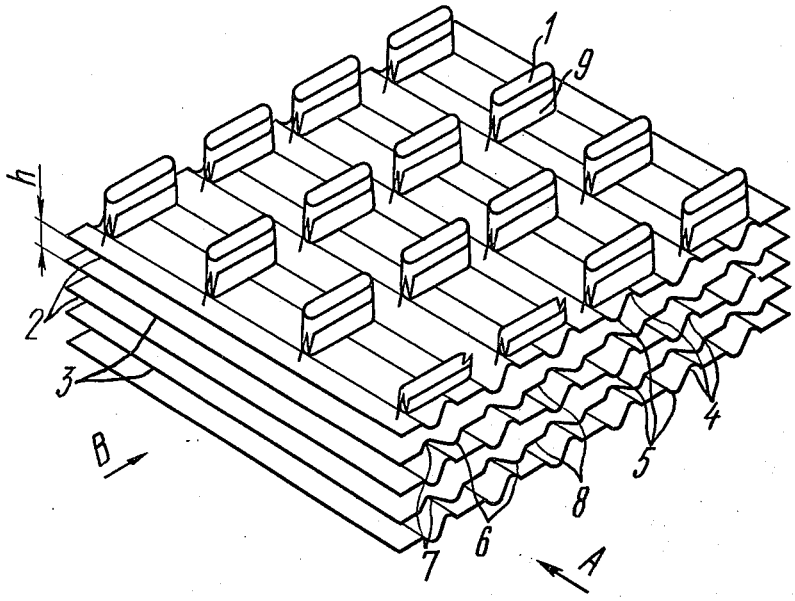
FIG. 1 is a general view of the tube-and-fin heat exchanger according to the invention.

The invention is disclosed below by reference to an embodiment thereof in the form of a water-air tube-and-fin tractor radiator.

The proposed tube-and-fin heat exchanger comprises, for example, parallel rows of flat tubes 1 (FIGS. 1 and 2) intended for the flow of a first heat carrier at some temperature. Upper fins 2 and adjacent lower fins 3, spaced apart a distance h, are fitted over the tubes. The adjacent upper fins 2 and lower fins 3 and the walls of the adjacent tubes 1 form a multiplicity of ducts for the flow of a second heat carrier, for example, air at a different temperature, intended to effect heat transfer from the first heat carrier, for example, water.

The profile of the fins 2 and 3 in the direction of the air flow indicated by the arrow B is formed by the profiles of the adjacent pairs of transverse projections 4 and depressions 5 in each adjacent upper fin 2 and by the profiles of the adjacent pairs of transverse projections 6 and depressions 7 in each adjacent lower fin 3. Rectilinear portions 8 are provided in each fin between each adjacent pair of transverse projections and depressions 4 and 5, 6 and 7. Broached holes 9 (FIG. 1) are provided in each fin 2 and 3.

The flat tubes 1 are connected with the fins 2 and 3 through the broached holes 9 so that the projections 4 (FIGS. 2 and 3) and depressions 5 in the fins 2 are located respectively opposite the projections 6 and the depressions 7 in the adjacent fins 3, the rectilinear portions 8 of each adjacent fin 2, 3 being located opposite each other. This construction provides ducts having the rectilinear portions 8 alternating with the divergent-convergent portions in the direction of the air flow. The research carried out by the inventors has disclosed that the turbulent condition of the air flow is minimum and the density of the heat flow is maximum in the layer at the wall of the ducts having no turbulence producing means. Therefore, in order to intensity heat transfer by virtue of setting up forced turbulence, supplementary energy should not be supplied throughout the flow section or, mainly, to the flow core, but it should be provided in the wall-neighbouring layer by generating therein three-dimensional vortex systems. It will be noted that found in the flow core are the highest values of turbulent conduction, the lowest values of the temperature gradient normal to the duct wall, and the lowest values of the heat flow density in the cross-sectional area of the cooling air flow. Therefore, additional turbulization of the flow core, which requires 70 to 90 percent of the supplementary energy given to the flow by the agency of turbulence producing means, practically results in little intensification of heat transfer in the duct. It follows that supplementary energy should be given to the heat carrier flow in the wall-neighbouring layer, i.e., in the part of the flow section where the maximum thermohydraulic effect can be obtained.

The process of heat transfer intensification in the apparatus of the present invention is as follows.

When air flows through the intertubular space in the divergent portions of the ducts, loss of hydrodynamic stability of the heat carrier flow occurs only on the walls of the divergent duct portions. As a result, three-dimensional vortices situated in the wall-neighbouring layer are generated on the divergent duct walls at the appropriate divergence angles and under the appropriate air flow conditions characterized by the number Re, the scale of the vortices being commensurable with the height of the transverse projections and depressions. The transfer air flow in the intertubular space ducts carries these vortices downstream in the wall-neighbouring layer in the rectilinear duct portion and the vortices die away, being gradually dissipated. Since, before dying away, the vortices do not reach the next divergent-convergent duct portion, there is no interaction with the next vortex generated in said duct portion. Also, there is no interaction with the flow core. No supplementary energy is supplied to the air flow core, whereby a decrease is effected in the overall energy expenditure on the intensification of heat transfer in the heat exchanger of the present invention.

The spacing h (FIG. 4) of the adjacent fins 2 and 3, the spacing m of the generatrices of apices 12 of the opposite depressions 5 and 7 (FIG. 2) in the adjacent fins 2 and 3, and the spacing n of side walls 11 of the adjacent flat tubes 1 are chosen depending on the range of variation of the ratio d*/d, which is the ratio of the equivalent diameters d* and d of the air duct, said diameters being characteristic of the apparatus under consideration. The length 1′ (FIG. 3) of the rectilinear duct portion 8 is chosen depending on the equivalent diameter d of the duct formed by the side walls 11 (FIG. 4) of the adjacent flat tubes 1 and the portions of fin flat surfaces 13.

In the apparatus of the present invention, the value of d* is taken for the narrowest section of the air duct formed by the side walls 11 of the adjacent flat tubes 1 and the generatrices of the apices 12 of the opposite depressions 5 and 7 (FIG. 2) in the adjacent fins 2 and 3. It is known that the equivalent diameter d* of this duct section is equal to four times the spacing n (FIG. 4) between the adjacent side walls 11 of the flat tubes 1 and the spacing m between the generatrices of the apices 12 of the opposite projections in the adjacent fins 2 and 3 divided by the double sum of the spacings n and m, i.e., $$d^* = \frac{4nm}{2(n+m)}.$$

The value of d is taken for the section of the air duct formed by the side walls 11 of the flat tubes 1 and the flat surfaces 13 of the adjacent fins 2 and 3. The equivalent hydraulic diameter d of this section is equal to four times the spacing n between the adjacent side walls 11 of the flat tubes 1 and the spacing h of the fins divided by the double sum of the spacings n and h, i.e., $$d = \frac{4nh}{2(n+h)}.$$

The thermohydraulic effectiveness of the heat exchanger is determined by the heat transfer intensification characterized by the ratio $Nu/Nu_o$ whereat the increasee in hydraulic losses is less than or equal to the increase in heat transfer, i.e., $$\frac{Nu/Nu_o}{\epsilon/\epsilon_o} \geqq 1 \quad (1)$$

where Nu and $Nu_o$ are Nusselt numbers respectively for the ducts of the heat transfer surface formed by the alternate rectilinear and divergent-convergent duct portions; and for the surface formed by identical plain ducts; $\epsilon$ and $\epsilon_o$ are coefficients of pressure losses respectively for the ducts of the heat transfer surface formed by alternate rectilinear and divergent-convergent duct portions, and for the surface formed by identical plain ducts.

Figure 5:
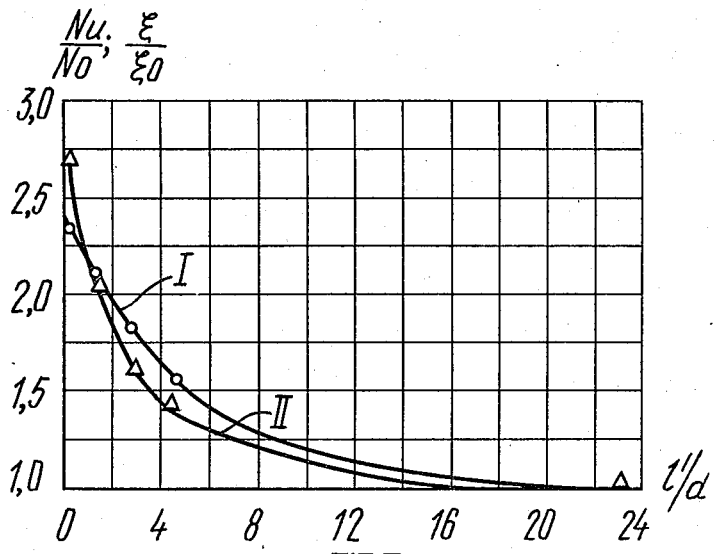
FIG. 5 is a graph of the relation $Nu/Nu_o=f(l'/d)$ and $\epsilon/\epsilon_o=f_1(l'/d)$.

On the graph of FIG. 5, the abscissa is the ratio 1′/d between the length of the rectilinear duct portions and the equivalent hydraulic diameter of the rectilinear duct portion; on the ordinate are the ratios $Nu/Nu_o$ and $\epsilon/\epsilon_o$ i.e., the Nusselt numbers and the coefficients of pressure losses plotted respectively for the ducts of the heat transfer surface formed by alternate rectilinear and divergent-convergent duct portions, and for the surface formed by identical plain ducts. The curve I shows the relation $Nu/Nu_o = f(1'/d)$. The curve II shows the relation $\epsilon/\epsilon_o = f_1(1'/d)$.

As is seen from the graph, at the cooling air flow characterized by the number Re=1700 the expression (I) is valid at $1'/d \geqq 1.0$. At $1'/d \geqq 16$ the apparatus of the present invention gives practically no thermohydraulic effectiveness. It is explained by the fact that with such a value of the length 1′ of the rectilinear portion of the duct 8 (FIG. 3) the laminary structure is restored in the wall-neighbouring layer of the cooling air rendered turbulent in the preceding divergent-convergent duct portion, whereupon the cooling air flow behaves as in an ordinary plain duct. Therefore, the next divergent-convergent portion is situated specifically where the structure of the wall-neighbouring air layer made previously turbulent becomes laminary, whereby the energy of vortices is fully utilized and expended in intensifying heat transfer by virtue of setting up turbulence in the wall-neighboring layer of the cooling air flow.

According to the experimental research carried out by the inventors, the highest thermohydraulic effectiveness of the proposed apparatus and the smallest size and mass thereof are obtained when the ratio and the specific spacing of cooling air throttling are within their variation ranges, respectively, $d^*/d = 0.60$ to 0.92 and $1'/d = 0$ to 5, i.e., the length 1′ of the duct rectilinear portions 8 does not exceed five equivalent hydraulic diameters d of said rectilinear duct portion 8. With decrease in the spacing h at the invariable height of the transverse projections, values of relation $d^*/d < 0.60$ decrease, increase in heat transfer practically ceases, whereas air pressure hydraulic losses increase sharply. This is explained by the fact that, as the spacing h decreases, a situation occurs wherein the height of the transverse projections exceeds the thickness of the air layer at the wall. Therefore, the vortices generated in the divergent duct portions, which are commensurable in scale with the height of the transverse projections, become situated not only in the air flow at the wall, but also in the flow core, which is objectionable. When the length 1′ of the rectilinear duct portions 8 is within five equivalent hydraulic diameters d of the rectilinear duct portions 8, the turbulent vortices generated in the divergent-convergent duct portion still have some energy, but cannot diffuse into the flow core when they come with the cooling air to the next divergent-convergent portion. Thus, in the tractor radiator disclosed herein, the length 1′ of the rectilinear duct portion, which is within five equivalent hydraulic diameters of the rectilinear duct portions, is optimum in the case of the given cooling air flow rate, throttling ratio d*/d, and the ratios $Nu/Nu_o$ and $\epsilon/\epsilon_o$.

In order to ensure uniform distribution of air in the heat exchanger air ducts, the rectilinear portions 8

(FIG. 2) of the fins 2 and 3 should be located in the plane of symmetry of the respective fin. Under these conditions, adjacent ducts have equal resistance to air flow and the thermohydraulic effectiveness of heat transfer in the proposed apparatus does not decrease.

Figure 2:
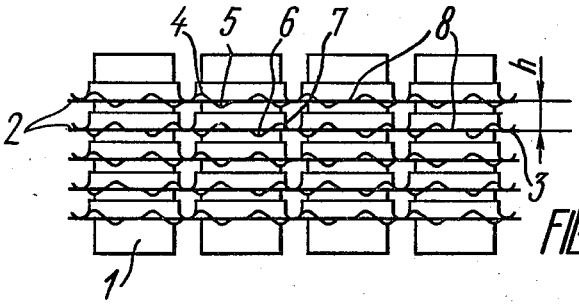
FIG. 2 is a view in the direction of the arrow A in FIG. 1.
Figure 3:
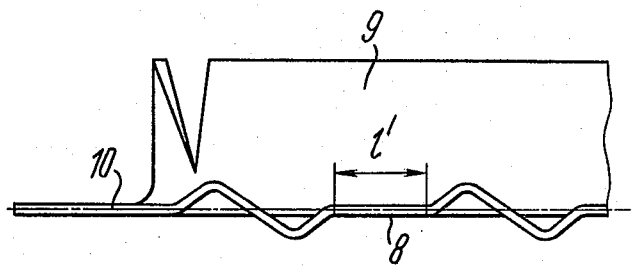
FIG. 3 is a sectional view showing the profile of one of the heat exchanger fins according to the invention.
Figure 4:
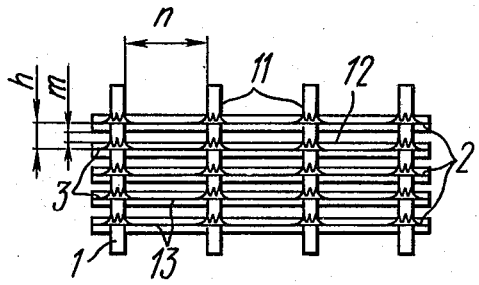
FIG. 4 is a view in the direction of the arrow B in FIG. 1.

Each divergent-convergent duct portion in the intertubular space can be formed by either one projection (depression) located on one of the adjacent fins or several mating projections and depressions, or one projection mating with one depression. The last embodiment of the tube-and-fin heat exchanger depicted in FIGS. 1, 2 and 3 is the best one inasmuch as it gives the highest thermohydraulic effectiveness and provides for the most expedient technology of making stamping outfit, which is characterized by the minimum number of surfaces needing manual finish, as compared with the other duct embodiments.

INDUSTRIAL APPLICABILITY

The use of the proposed tube-and-fin heat exchanger as a water-to-air tractor radiator enables up to two-fold decrease of its volume and mass, all other things being equal. Taking into consideration that water radiators for tractors, motor vehicles and diesel locomotives are made of expensive and scarce materials and produced on a large scale, the use of the proposed tube-and-fin heat exchanger for the aforementioned purposes will effect large economics.

We claim:

1. A tube-and fin heat exchanger comprising tubes for the flow of a heat carrier at some temperature, which tubes are installed in broached holes provided in fins spaced apart and positioned so that adjacent fins and walls of adjacent tubes form a multiplicity of ducts for the flow of a heat carrier at a different temperature, each of the fins having projections, depressions and rectilinear portions, said projections and depressions of one fin being located respectively opposite projections and depressions on the adjacent fins and forming in said ducts symmetrical divergent-convergent portions for setting up turbulence in the wall-neighbouring layer of the heat carrier flowing therethrough, said rectilinear portions being disposed between the convergent-divergent duct portions and opposite each other on the adjacent fins so as to reduce interaction between a vortex formed in one divergent-convergent portion with a vortex formed in the next adjacent divergent-convergent portion.

2. A tube-and-fin heat exchanger according to claim 1, wherein the length of the rectilinear fin portions does not exceed the value at which the laminary structure is restored in the wall-neighbouring layer of the heat carrier flow rendered turbulent in the divergent-convergent portion of the duct.

3. A tube-and-fin heat exchanger according to claim 2, wherein the length of the rectilinear fin portions does not exceed five equivalent hydraulic diameters of the rectilinear portions of the ducts.

4. A tube-and-fin heat exchanger according to any one of claims 1-3, wherein the rectilinear fin portions are situated in the plane of symmetry of the respective fin.

5. A tube-and-fin heat exchanger according to any one of claims 1 to 3, wherein each divergent-convergent portion is formed by at least one projection mating with at least one depression.

6. A tube-and-fin heat exchanger according to claim 4, wherein each divergent-convergent portion is formed by at least one projection mating with at least one depression.

* * * * *